US006844538B1

(12) United States Patent
Hollock et al.

(10) Patent No.: US 6,844,538 B1
(45) Date of Patent: Jan. 18, 2005

(54) RADIATION DETECTION APPARATUS

(75) Inventors: Stephen Hollock, Lechlade (GB); Bryan Lorrain Humphreys Wilson, Towcester (GB); Stephen George Porter, Towcester (GB)

(73) Assignee: Infrared Integrated Systems Limited, Towcester (GB)

( * ) Notice: Subject to any disclaimer, the term of this patent is extended or adjusted under 35 U.S.C. 154(b) by 0 days.

(21) Appl. No.: 09/558,279

(22) Filed: Apr. 25, 2000

(30) Foreign Application Priority Data

Apr. 26, 1999 (GB) ..... 9909595

(51) Int. Cl.[7] ..... H01J 40/14

(52) U.S. Cl. ..... 250/214 R; 250/342; 250/353; 340/565

(58) Field of Search ..... 250/214 R, 221, 250/342, 353, 203.1, DIG. 1; 340/555, 556, 557, 566, 567; 382/173

(56) References Cited

U.S. PATENT DOCUMENTS

| | | | | | |
|---|---|---|---|---|---|
| 4,514,630 | A | | 4/1985 | Takahashi | 250/342 |
| 4,841,284 | A | | 6/1989 | Biersdorff | 340/567 |
| 5,146,073 | A | * | 9/1992 | Wirth et al. | 250/201.9 |
| 5,393,978 | A | * | 2/1995 | Schwarz | 250/353 |
| 5,617,077 | A | * | 4/1997 | Wiemeyer et al. | 340/628 |
| 5,677,529 | A | * | 10/1997 | Hofmann et al. | 250/221 |
| 5,852,516 | A | * | 12/1998 | Chipper | 359/676 |
| 5,929,445 | A | * | 7/1999 | Barone | 250/353 |
| 6,118,852 | A | * | 9/2000 | Rogers et al. | 378/140 |
| 6,239,437 | B1 | * | 5/2001 | Barone | 250/353 |

FOREIGN PATENT DOCUMENTS

| | | |
|---|---|---|
| GB | 2 286 042 | 8/1995 |
| JP | 9 305871 | 11/1997 |
| JP | 10-213672 | 11/1998 |

OTHER PUBLICATIONS

European Patent Search Report for GB 9909595.2, Jul. 13, 1999, 2 pages.

* cited by examiner

*Primary Examiner*—Edward J. Glick
*Assistant Examiner*—Courtney Thomas
(74) *Attorney, Agent, or Firm*—Moser, Patterson & Sheridan, L.L.P.

(57) ABSTRACT

A radiation detection apparatus is capable of detecting and locating events, such as a fire or the appearance of an intruder, in a scene under surveillance. The apparatus comprises an array of detector elements, e.g. infrared detectors. The apparatus has two fields of view, namely a first field of view defined by a lens providing a single focussed image of a distant scene on the array and a second field of view defined by a reflector arranged between a plane of the array and a plane of the lens whereby to reflect onto the detector array radiation entering the lens from outside the first field of view. One or more processors are provided to distinguish events in the second field of view from those in the first field of view.

32 Claims, 3 Drawing Sheets

RADIATION DETECTION APPARATUS

BACKGROUND

The combination of a lens and a detector array is commonly used to give an image of a scene on the array. The scene is imaged on the detector array and the angular extent of the scene that can be imaged is limited by the angular aperture of the lens that gives adequate resolution, and the size of the detector array. Radiation entering more obliquely does not normally fall on the detector array directly and indeed for such rays the imaging capability of the lens may be impaired. This is illustrated in FIG. 1 which shows rays from a distant scene falling on a lens 1 and, possibly after passing through a filter 4, form an image on the detector array 2 placed in the focal plane of the lens. Rays such as AA' and BB' give rise to elements of an image of acceptable quality and the detector array may therefore be placed so that A is illuminated by such rays. More oblique rays such as CC' give rise to a distorted image of unacceptable quality for the accuracy of imaging required and fall outside the detector array. Rays incident at angles which give rise to acceptable images are said to be within the normal angular aperture of the lens. More oblique illumination is usually prevented from falling on the array by stops and by blacking the interior of the equipment. An arrangement is described which utilises these oblique rays so that the normal operation of the array is enhanced by some sensitivity to more oblique illumination. These oblique rays could of course be used in combination with a larger detector array covering the area where rays such as CC' approximately converge, but the additional expense of employing a larger detector array and a larger aperture filter may be undesirable. The arrangement to be described can be used to enhance sensitivity, albeit without imaging, outside the portion of the scene which is normally imaged. No such arrangements are required where individual detectors are used to monitor events without imaging, as the angular aperture, for example that determined by a window, can be varied at will, and the question of image quality does not arise.

One application of the invention arises in the testing of equipment embodying a lens and detector array. Often in conjunction with a window. Where detectors are in continuous use to monitor events, particularly those required to indicate a fault or alarm condition. it is desirable to test frequently the continued operation of the detectors and the cleanliness of any window fixed in its housing. For systems where the monitoring uses single detectors with no focusing optics, arrangements are known where this monitoring is accomplished by mounting within the detector housing a subsidiary source of radiation within the wavelength range where the detector is sensitive. Radiation is prevented from falling directly on the detector by a suitable shield but emerges through a portion of the window and is reflected back through another portion of the window on to the detector. If the window is blocked or the detector has ceased to operate no signal due to the internal source is received. Partial obscuration or imperfect operation of the detector will result in a smaller signal. A class of such arrangements is described in U.S. Pat. No. 3,952,196 (1976). The incorporation of the source within the housing which can be sealed not only is convenient mechanically but the seal prevents the source itself from coming into contact with the air externally and constituting an additional risk of fire or explosion. However where an array of detectors is used with a lens to focus an image of the scene on to it, it is desirable to test not only that the window remains clean but also whether each element of the array continues to operate. For this purpose it is necessary to irradiate all the elements (but not necessarily simultaneously) of the detector array from the test source through the window whilst shielding the elements from direct exposure to the source of radiation. As a lens is used to focus the radiation from the external scene on to the detector array simple arrangements that are used with single detectors cannot be used.

SUMMARY OF THE CURRENT INVENTION

The present invention provides radiation detection apparatus capable of detecting and locating events in a scene under surveillance comprising a detector array and a lens arranged to provide a single focussed image of a distant scene on the array, the apparatus further comprising a reflector situated between the plane of the array and the plane of the lens so as to extend the field of view by reflecting onto the detector array radiation entering the lens from outside the normally imaged field of view of the array-lens combination.

Preferred features of the invention will become apparent from the following description. In particular, the reflector may have cylindrical symmetry about the optical axis of the lens. For example, the reflector may be a right circular cylinder. A reflector may be arranged to reflect radiation from a test source to the lens. This reflector may be frustoconical.

Advantages of the claimed radiation detector will become apparent from the following description.

Embodiments of the invention will now be described by wvav of example only and with reference to the accompanying drawings in which.

GENERAL DESCRIPTION

Figure 1:
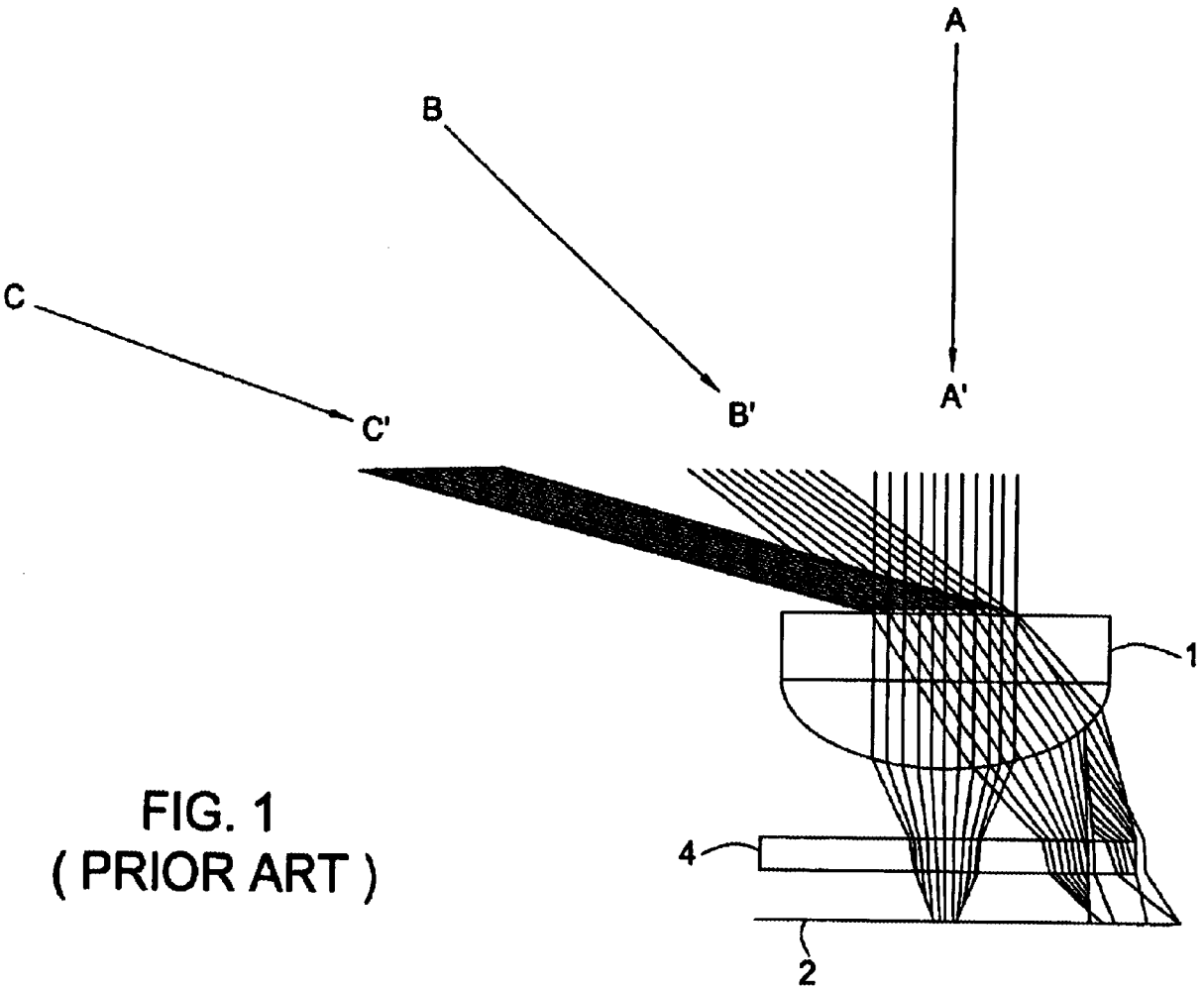
FIG. 1 ( PRIOR ART )
FIG. 1 illustrates an arrangement of a lens and detector array.
Figure 2:
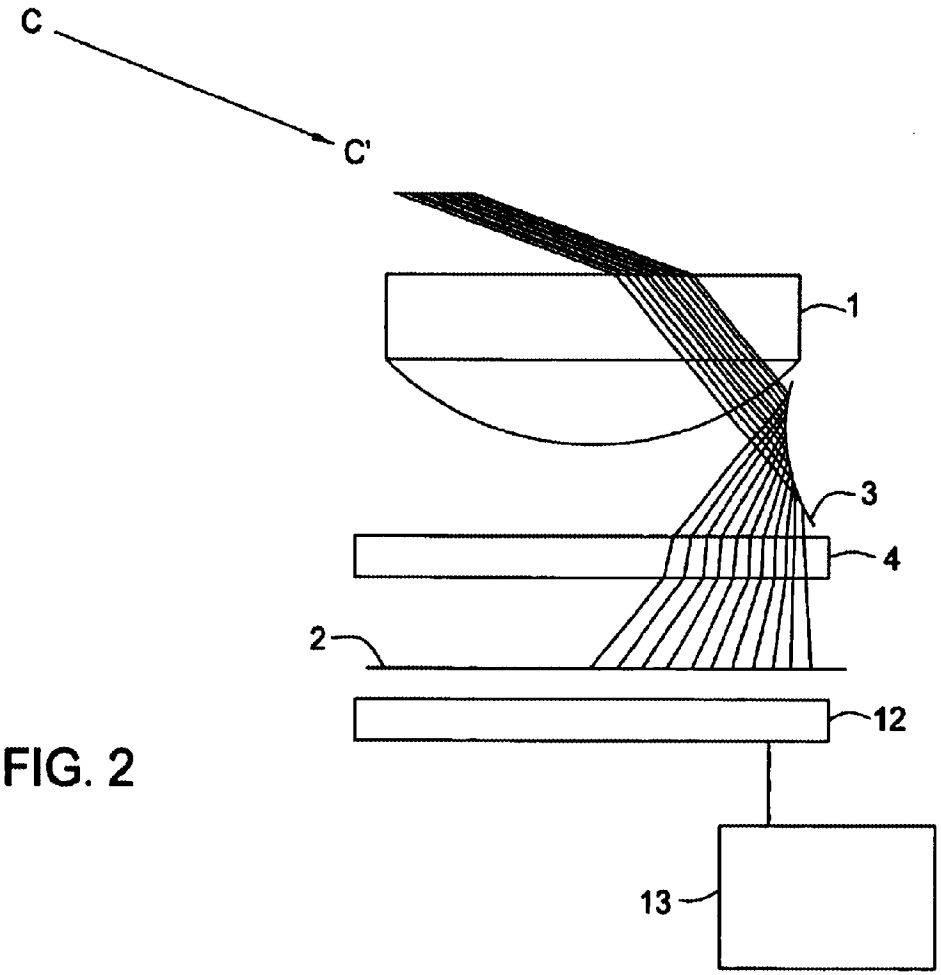
FIG. 2 illustrates schematically a first embodiment of radiation detection apparatus according to the invention.

FIG. 2 shows a similar arrangement of lens 1, detector array 2 and possibly a transparent filter 4, to that of FIG. 1 but oblique rays, such as CC', from a distant point fall on a mirror 3 positioned so that they are reflected back on to the array. In order to ensure that rays of the same inclination as CC' but outside the plane of the paper fall on the array the mirror 3 will be an annular mirror with the same axis as the lens, though exact cylindrical symmetry may not be necessary. The curvature of the mirror in the plane of the paper determines which parts of the array are illuminated by oblique rays. The Figure illustrates how with a convex mirror 3 oblique illumination by rays such as CC' from a point source outside the normally imaged scene are reflected onto the array to form a line of illumination in the plane shown in the Figure. If the mirror is a curved annular mirror, point sources at any azimuthal angle situated outside the normally imaged scene will give rise to illumination on the array centered about a line at the corresponding azimuthal angle. It is not always necessary for the mirror to have good optical quality and components fabricated from bright metal or metallised plastic may suffice. The effect of this arrangement is to extend the field of view of the detector array; the field may be divided conceptually into two parts, an inner part where the scene is focused normally, and an outer part where rays from a distant point in the scene illuminate more than one element of the detector array. The lens detector array combination can be used to detect and locate events occurring at individual locations within the normally imaged scene. If an event occurs at an individual location outside the normally imaged scene, such that an arrangement such as that of FIG. 2 causes it to fall on a number of detectors in the array, the arrangement can also be used to detect the event and locate it approximately in azimuth but not in elevation. The location of elements of the detector array where signals are above a pre-set threshold is determined and well known pattern recognition algorithms can be employed to establish that the locations are contiguous and lie near a particular azimuthal direction. Suitable detector arrays for use in the invention described include pyroelectric and other thermal detector arrays. Such arrays can be sensitive to a wide range of events in the scene inducing fire and intruders, and can be mounted on or form an integral part of a silicon integrated circuit 12 which is used to interrogate the array. This integrated circuit 12 may in turn be connected to one or more microprocessors 13 to further analyses the signals.

Figure 3:
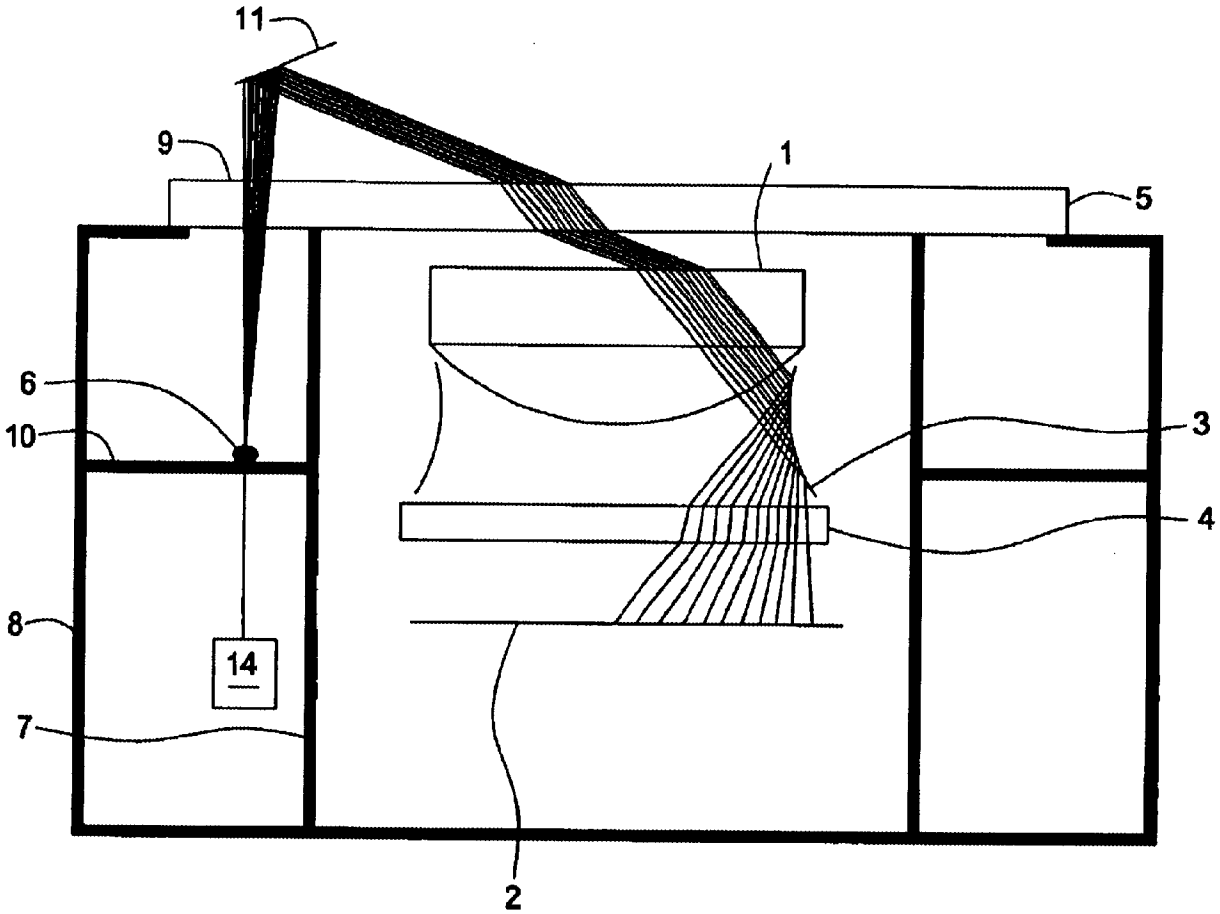
FIG. 3 illustrates schematically a second embodiment of radiation detection apparatus according to the invention.

This scheme can also be used to test the integrity of the array and the window of its housing. It is very desirable that test sources of illumination should not be placed within the angular aperture used for imaging as the would shield some of the detectors from radiation sources in the scene behind them. A suitable arrangement that overcomes this difficulty is given. By way of example only, in FIG. 3. To expound this aspect of the invention it is convenient to assume that the detector housing 8 and the optics have circular symmetry about a line which is the axis of the lens 1 used to focus the radiation from the scene on to the detector array 2, although this need not necessarily be the case. The detector array 2 will generally be square or rectangular, corresponding to the aspect ratio of the scene in which it is desired to monitor events. The lens is situated below a window 5 mounted on and possibly sealed into the housing 8. A filter 4 may be mounted between the lens and the detector. A cylindrical opaque shield 7 surrounds the lens and detector array. The window however extends outside the shield. Outside the shield is a source or sources of light or infrared radiation 6 to which the detector is sensitive and within the pass band of the window. This source of radiation may have circular symmetry about the optical axis, and may be mounted on or form an integral part of a mount 10. The shield presents radiation from the source or sources 6 from falling directly onto the array.

In the case of a detector array provided with common mode rejection, the elements of the array may be illuminated by the test source at different times. For example, the source of radiation may be separated into two or more independent sections. These sections will illuminate different sections of the detector array and can be modulated independently so that the whole array may be tested in two or more parts.

Radiation from the source 6, which may be modulated to distinguish it from radiation from the scene, is directed towards a portion 9 of the window 5 and after passing through it meets a first annular mirror 11, whose axis is the same as the lens axis. This mirror, 11, is inclined at an angle of approximately 60 degrees to the optical axis of the lens, and reflects the radiation back through the Window towards the lens. The radiation is refracted by the lens but continues to travel outwards from the axis of the lens. It then encounters a second annular mirror 3 whose axis is parallel with the lens optical axis, and which reflects it towards the detector array 2. The use of the word mirror above does not necessarily imply high optical quality, and bright metal rings or metallised plastic may be sufficient. Dependent on the F number of the lens, it may be desirable to use curved mirrors. Generally, but not exclusively in any section through the axis of the lens the first mirror will be plane or concave, and the second mirror still be plane or convex: both mirrors are annular in a plane at right angles to the axis of the lens. Such an arrangement, whose details are dependent on the F number of the lens, the size of the detector array and other variables in the geometry, is capable of illuminating the detector array sufficiently uniformly to allow testing of all the elements of the array and the cleanliness of the window.

Suitable sources for testing the array include discharge tubes, heated filaments and light emitting diodes, according to the wave band being tested. Where it is not convenient or cost effective to use an annular source, it will often be sufficient to use a number of smaller sources arranged round the circumference of a circle. For detector arrays operating in the region 2–15 $\mu$m, an electrically heated filament may be used or a ring of an electrically heated refractor, metal film such as nichrome on a glass or ceramic substrate. The source may be placed on the package window, but outside the aperture used for viewing the external scene. The sources in these examples illustrate but do not limit the scope of the invention.

While most sources can be directly modulated by an alternating current, the ease of modulation and the fraction of the total power that emerges as modulated radiation make certain sources such as light emitting diodes more appropriate. The refractory metal film described above may be more easily modulated if it is on a poorly conducting substrate than on a highly conducting substrate. Modulation can also be effected by an external chopper, but such arrangements are less compact less reliable for long-term operation, and less suitable for automatic testing.

Where a detector array is in more or less continuous use, for example in surveillance or fire detection, it can be arranged that the test source is switched on at intervals under the control of a microprocessor 14. The additional signal from the detectors is monitored to ensure correct operation. Discrimination between the test radiation and that from the scene being viewed is simplified by using a modulated test source. Failures or loss of sensitivity of individual detectors may be distinguished from loss of transparency of the window or overall loss of detector sensitivity by analysis of the array output; this can be done by a microprocessor or microprocessors connected to the detector array so that different fault conditions for the equipment can be discriminated. As all the detectors are illuminated by the source, the failure of any detector may be seen in analying the signal from the array when the test source is operated. Furthermore if the window becomes partially or completely obscured in operation there will be a diminution or absence of the signal from some or all of the detectors when the test source is operated.

What is claimed is:

1. Radiation detection apparatus capable of detecting and locating events in a scene under surveillance, comprising:

a two dimensional detector array and a lens arranged to define a first field of view of the apparatus and to provide a single focused image of a distant scene on the array; and a reflector arranged between the plane of the array and the plane of the lens to define a second field of view which extends beyond the first field of view and to reflect onto the detector array radiation entering the lens from outside the first field of view.

2. The apparatus of claim 1, wherein the two dimensional detector array is a square or rectangular detector array.

3. The apparatus of claim 1, wherein the two dimensional detector array provides spatial information relating to the detected events.

4. The apparatus of claim 1, wherein the two dimensional detector array distinguishes events in the second field of view from those in the first field of view.

5. Radiation detection apparatus capable of detecting and locating events in a scene under surveillance, comprising:

a detector array and a lens arranged to define a first field of view of the apparatus and to provide a single focussed image of a distant scene on the array;

a reflector arranged between a plane of the array and a plane of the lens to define a second field of view which extends beyond the first field of view and to reflect onto the detector array radiation entering the lens from outside the first field of view; and one or more processors for distinguishing events in the second field of view from those in the first field of view.

6. Apparatus as claimed in claim 5 in which the lens is plano-convex and a planar surface of the lens is directed towards the scene.

7. Apparatus as claimed in claim 5 in which the reflector has cylindrical symmetry about an optical axis of the lens.

8. Apparatus as claimed in claim 5 in which the reflector has one or more convex reflecting surfaces.

9. Apparatus as claimed in claim 5 in which the reflector has one or more planar reflecting surfaces.

10. Apparatus as claimed in claim 5 wherein the one or more processors comprise one or more pattern recognition algorithms.

11. Apparatus as claimed in claim 5 including a test source of radiation arranged to emit radiation onto the lens from outside the first field of view of the apparatus.

12. Apparatus as claimed in claim 11 in which the source illuminates different elements of the detector array at different times.

13. Apparatus as claimed in claim 11 further comprising a shielding member for shielding the detector array from the test source.

14. Apparatus as claimed in claim 11 further comprising a second reflector arranged to reflect radiation from the test source towards the lens.

15. Apparatus as claimed in claim 14 in which the second reflector has one or more concave surfaces.

16. Apparatus as claimed in claim 14 in which the second reflector is frusto-conical.

17. Apparatus as claimed in claim 14 in which the second reflector has one or more planar reflective surfaces.

18. Apparatus as claimed in claim 14 in which the second reflector has cylindrical symmetry about the optical axis of the lens.

19. Apparatus as claimed in claim 14 in which the reflector and the second reflector are arranged to reflect radiation onto the whole of the detector array.

20. Apparatus as claimed in claim 11 in which the lens is protected by a window and the source is located inside the window.

21. Apparatus as claimed in claim 20 in which the second reflector is located outside the window.

22. Apparatus as claimed in claim 11 wherein the test source has means for modulating its output, whereby radiation from the test source can be distinguished from radiation from a scene being viewed.

23. Apparatus as claimed in claim 11 including a microprocessor for switching on the test source at intervals.

24. Apparatus as claimed in claim 11 in which the test source comprises one or more emitters arranged about the optical axis of the lens.

25. Apparatus as claimed in claim 11 in which the source comprises one or more electrically heated filaments.

26. Apparatus as claimed in claim 11 in which the test source comprises a refractory metal film deposited on a substrate.

27. Apparatus as claimed in claim 20 in which the test source comprises a refractory metal film deposited on a substrate and the substrate is the window.

28. Apparatus as claimed in claim 11 in which the test source is a single continuous radiating element with circular symmetry about the optical axis of the lens.

29. Apparatus as claimed in claim 11 in which the source comprises one or more light emitting diodes.

30. Apparatus as claimed in claim 5 in which the array is an array of thermal detectors.

31. Apparatus as claimed in claim 30 in which the array is an array of pyroelectric detectors.

32. Apparatus as claimed in claim 5 in which the detector array is formed in or mounted on a semiconductor integrated circuit that is used to interrogate it.

* * * * *